US007249427B2

(12) United States Patent
Jungkind

(10) Patent No.: US 7,249,427 B2
(45) Date of Patent: Jul. 31, 2007

(54) SPORTS SHOE WITH CLEATS

(76) Inventor: Roland Jungkind, Bärenalpstrasse 3, Garmisch-Partenkirchen D-82467 (DE)

( * ) Notice: Subject to any disclaimer, the term of this patent is extended or adjusted under 35 U.S.C. 154(b) by 42 days.

(21) Appl. No.: 10/500,022

(22) PCT Filed: Dec. 23, 2002

(86) PCT No.: PCT/DE02/04749

§ 371 (c)(1),
(2), (4) Date: Feb. 10, 2005

(87) PCT Pub. No.: WO03/055341

PCT Pub. Date: Jul. 10, 2003

(65) Prior Publication Data

US 2005/0160629 A1 Jul. 28, 2005

(30) Foreign Application Priority Data

Dec. 28, 2001 (DE) ..... 101 63 999

(51) Int. Cl.
*A43B 5/00* (2006.01)

(52) U.S. Cl. ..... 36/134; 36/67 D

(58) Field of Classification Search ..... 36/134, 36/67 D

See application file for complete search history.

(56) References Cited

U.S. PATENT DOCUMENTS

| | | | | |
|---|---|---|---|---|
| 2,185,397 | A * | 1/1940 | Birchfield | 36/59 R |
| 5,638,615 | A | 6/1997 | Korsen | |
| 5,956,871 | A * | 9/1999 | Korsen | 36/134 |
| 6,463,681 | B1 * | 10/2002 | Savoie | 36/134 |
| 6,513,266 | B1 * | 2/2003 | Ijiri | 36/134 |
| 2002/0020079 | A1 | 2/2002 | Sato et al. | |
| 2003/0106245 | A1 * | 6/2003 | Hsiao | 36/134 |

FOREIGN PATENT DOCUMENTS

JP 2001-340110 12/2001

* cited by examiner

*Primary Examiner*—Ted Kavanaugh
(74) *Attorney, Agent, or Firm*—D. Peter Hochberg; Sean Mellino

(57) ABSTRACT

According to the invention, a cleat for sport shoes has a locking pin for automatically locking the pin in a receptacle of the sole of the shoe through a spring, and a release mechanism for moving the spring to a releasing position upon rotation of the cleat for releasing the cleat.

16 Claims, 2 Drawing Sheets

SPORTS SHOE WITH CLEATS

CROSS REFERENCE TO RELATED APPLICATIONS

This application is the National Stage of International Application No. PCT/DE02/04749 filed Dec. 23, 2002 and claims priority from German Application Ser. No. 101 63 999.6 filed Dec. 28, 2001.

BACKGROUND OF THE INVENTION

1. Field of the Invention

This invention comprises a sport shoe with a sole that holds a removable cleat attached to the sole, wherein the cleat has a locking section that reaches behind a receptacle in the sole.

2. Description of the Prior Art

A sport shoe of this type is known, for example from EP 0 815 759. The sport shoe has a sole with cleats removably attached to it, wherein the cleats are held at the sole through a shape locked connection and a securing device. This shape-locked connection is accomplished by means of a multi-cornered socket on the cleat and a complementary receptacle in the sole, for example, whereas the securing device is a screw on the cleat and a threaded opening in the sole. The shape-locked connection and the securing device are arranged perpendicular to the surface of the sole. Handling this type of cleat is relatively cumbersome, since first the connection between the screw and the screw opening has to be made when replacing a cleat, whereupon the hexagonal shape has to be placed in the right position with its complementary receptacle. The user is thus forced to hold the cleat in position with one hand while tightening the screw with the other hand.

Another type of connection of a round cleat to the sole of a sport shoe is described in U.S. Pat. No. 4,698,923. The cleat is pressed into a receptacle in the sole with the help of a tool and is then rotated until locking tabs that protrude from the cleat reach behind an undercut in the receptacle. The disadvantage to this embodiment is that when inserting a cleat, two procedures have to be done: one involves the insertion of the cleat into the receptacle and the other involves rotating it into the correct locked position. If cleats have to be replaced quickly, which frequently occurs in practice, a device of this type is cumbersome.

Another embodiment has been made known through DE 198 50 449 in which preferably elongated cleats are first inserted into a receptacle in the sole and then are locked into a position that reaches behind the receptacle by means of a screwed connection and a locking hook. In this case, as well, manipulation is not very easy, similar to the prior art mentioned above.

It is easier to insert a cleat into the sole of a sport shoe as described in the embodiment according to DE 298 07 082 U1 in that the cleat only has to be pressed into the receptacle. Nevertheless, the cleat is secured using an expanding core that has to be fixed to an opening of the cleat in order to lock the cleat in its position. Moreover, removing the cleat is very cumbersome since first the expanding core has to be removed from its locked position in order to then be able to remove the cleat from the receptacle. Particularly for dirty soles, this can be very difficult to do and can take a lot of time.

SUMMARY OF THE INVENTION

The object of this invention is to create a sport shoe with cleats wherein it is easy not only to attach, but also to remove a cleat from the sole even if it is dirty, and wherein above all this can be done quickly, said sport shoe characterized by its use of few parts, its compactness and its robustness.

This object is met through the characterizing features of a removable cleat that attaches to the sole of a sport shoe, wherein the cleat has a locking section that reaches behind a receptacle in the sole and the locking section consists of a locking pin that protrudes in the direction of the longitudinal axis of the cleat.

Advantageous embodiments of the invention are described in the subordinate claims.

The invention is based on the general idea that it should be easy to bring a cleat to its locked position by hand by pressing it in the direction of the opening of the receptacle in the sole. In addition, by appropriately designing the individual inclines on the locking part, there is no need to be sure of the correct position when pressing the cleats in, since the locking part finds this position itself via the inclines. Likewise, removing the cleat from the sole is done using a suitable tool, such as is commonly used for round cleats, to turn the cleat. By turning or rotating the cleat by a maximum of one half turn, because of the shape of the locking pin, the cleat then releases itself from the locked position and becomes able to be removed.

The object of the invention is met through a process to quickly install a removable cleat wherein the installation of the cleat is done by simply pressing it by hand into the receptacle of the sole of the sports shoe until the cleat reaches its locked position in which a locking pin of the cleat has become locked by a spring and in which it cannot be moved longitudinally or laterally, whereas the removal is accomplished with the help of a tool by rotating the cleat by one-half of a turn, the cleat unlocking by itself through spreading surfaces and releasing from the receptacle of the sole.

BRIEF DESCRIPTION OF THE DRAWINGS

Below, the invention is explained in more detail with the help of the drawing. Shown are.

DESCRIPTION OF THE PREFERRED EMBODIMENTS

Figure 1:
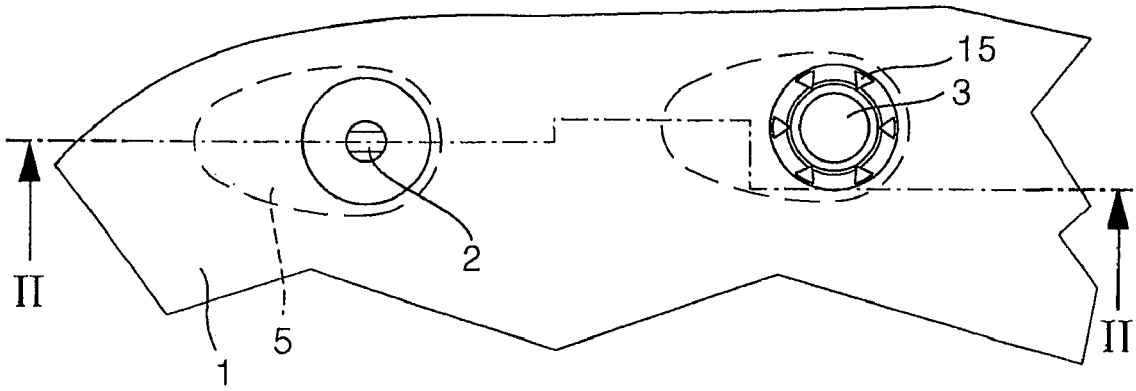
FIG. 1 a partial view of a sole of a sport shoe with an installed cleat (on the right) and a receptacle without a cleat (on the left)
Figure 5:
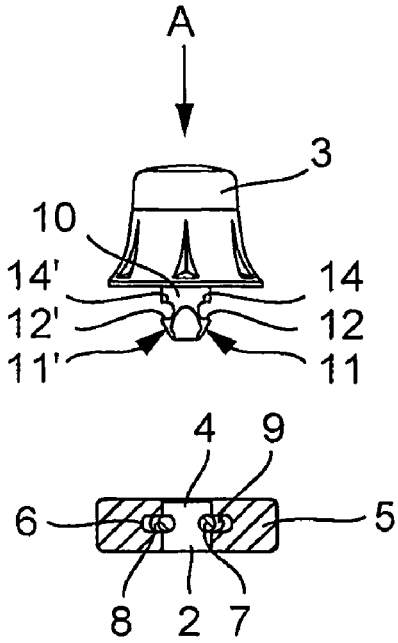
FIG. 5 is a side view of the cleat of FIG. 4 and a sectional view of the locking frame according to line V—V in FIG. 4.
Figure 4:
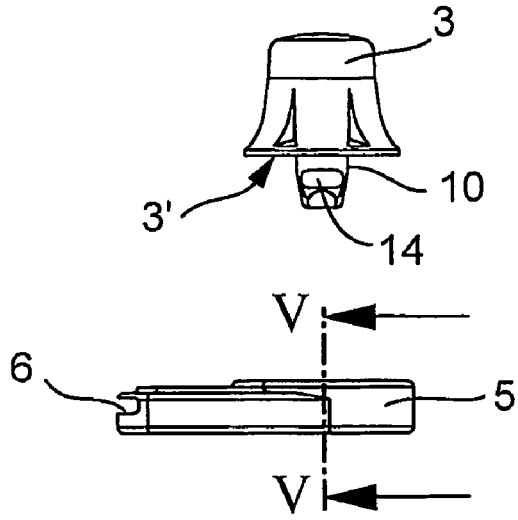
FIG. 4 is a view of a cleat and locking frame, without the sole (at an enlarged scale)
Figure 6:
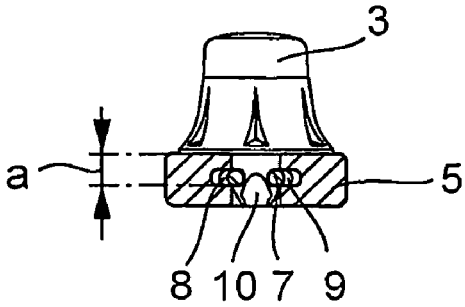
FIG. 6 is a view of the cleat according to FIG. 5 in the locked position (without the sole)

In FIG. 1, part of a sole 1 of a sport shoe that is not shown in more detail, such as is used in lawn sports, has receptacles 2 on its bottom surface at numerous points to hold cleats 3.

In the example shown, such a cleat 3 is attached to the right side, whereas there has not yet been one attached to the left side.

Figure 3:
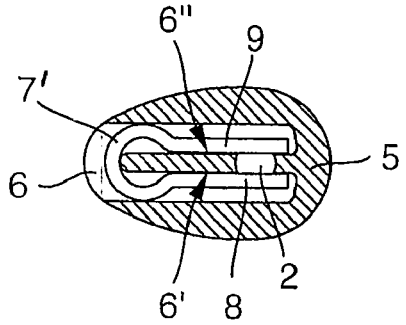
FIG. 3 is a view of the locking frame according to line III—III in FIG. 2.
Figure 2:
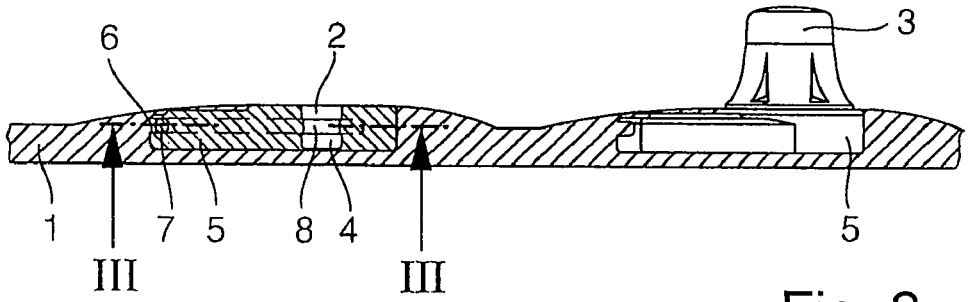
FIG. 2 is a side view along line II—II in FIG. 1.

As is very easy to see, especially from FIGS. 2 and 3, this receptacle 2 is preferably designed as a round hole 4 and is provided in a locking frame 5 that is injected or glued into the sole 1 as a separate part. Of course, other types of connections between the sole 1 and the locking frame 5 are possible, or the locking frame could also be an integral part of the sole.

A locking spring 7 is located inside the locking frame 5 in a spring channel 6. In one embodiment, the spring channel is U-shaped and holds a U-shaped torsion spring 7' with a round cross section extending into the round receptacle 2. Both sides 8, 9 of the torsion spring 7' are pre-tensioned in the direction of the receptacle 2 and are supported by the walls 6' and 6" of the spring channel 6.

From FIGS. 4–7 it can be seen that the cleat 3 has a central locking pin 10 that projects outward in the direction of its longitudinal axis. This locking pin 10 can preferably be made of metal, as can the cleat 3, so that the locking pin is integral with the core of the cleat. Of course, there are other conceivable materials as well for either the locking pin or the cleat, or the cleat can be made of one material, such as plastic, while the locking pin can be made of another material, such as metal.

The locking pin 10 has a cross section that corresponds to the cross section of the receptacle 2 or the round hole 4 so that it fits into the receptacle 2. What is essential to the invention is that the locking pin 10 has surfaces as described in more detail below.

To be able to press the cleat by hand easily into the receptacle 2 in the direction of arrow "A" (see FIG. 5), the locking pin 10 has diametrically opposed insertion inclines 11, 11' that have an angle that is preferably 35°–45° with respect to the longitudinal axis. These insertion inclines 11, 11', push the sides 8, 9 of the spring of the locking spring 7 away from one another when the cleat is pressed in until the locking pin 10 has reached its final locked position according to FIG. 6.

The locked position is secured through locking surfaces 12, 12' on the locking pin 10 that are likewise diametrically opposed against which the sides 8, 9 of the locking spring 7 are supported, preventing the cleat 3 from moving in its longitudinal and/or lateral axis. Thus, to one trained in the art, it is clear that distance "a" according to FIG. 6 between the support surface 3' of the cleat 3 and locking surfaces 12, 12' must be such that in the locked state there is no play between the support surface 3' and the sole 1 and such that the cleat 3 sits perfectly flat against the sole 1 as a result. Also, it is important that the locking surfaces 12, 12' have a length of at least half of the diameter of a side 8, 9 of the spring and that they have an angle of 85 °–95° with respect to the longitudinal axis of the cleat 3, preferably 90°.

Figure 7:
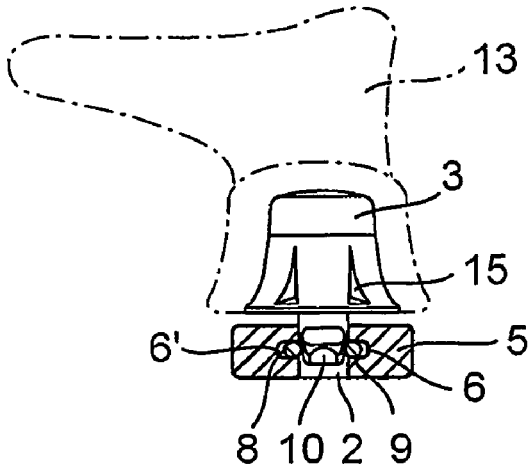
FIG. 7 is a view of the cleat according to FIG. 6, but just prior to its being unlocked from the locking frame.

In order to remove the cleat 3 from the sole 1 from its locked position, the cleat 3 is rotated one half of a turn with the aid of a tool 13, which is schematically illustrated in FIG. 7. In this case, the sides 8, 9 of the locking spring 7 are pushed apart by opposing spreading surfaces 14, 14' on the locking pin 10 so that they move in the opposite direction away from the channel walls 6', 6" and release the locking pin 10. In the process, the direction in which the cleat 3 is rotated makes no difference. The cleat 3 can then be removed unhindered from the receptacle 2 and locking frame 5.

So that the tool 13 can interlock with or engage the cleat 3, the cleat has a plurality of spurs 15 located on the perimeter that mate with complementary recesses in the tool, which are not shown in more detail.

It should be noted that this invention is not restricted to the embodiment as illustrated and described, but that alterations apparent to one trained in the art should be included as well.

What is claimed is:

1. A sport shoe for holding at least one removable cleat, said sport shoe comprising:

a sole having at least one receptacle for receiving a cleat;

a removable cleat having a longitudinal axis and a locking pin along the longitudinal axis of said cleat; and a locking spring located in said receptacle;

said locking spring engaging said locking pin for locking said cleat to said sole in response to the insertion of said locking pin into said receptacle;

wherein said sole further comprises a spring channel extending from and around said receptacle and having support walls in said spring channel, and said spring sides being pre-tensioned in the direction of said receptacle and being supported off said support walls, said spring sides having a locking condition for engaging said locking pin to releasably lock said pin in a locked condition in said receptacle.

2. A sport shoe according to claim 1, wherein said locking pin has a cross section, and said receptacle comprises a round hole with the same cross section as the cross section of said locking pin.

3. A sport shoe according to claim 1, wherein said sole further comprises a locking frame defining said receptacle and for holding said locking spring.

4. A sport shoe according to claim 1, wherein said locking frame comprises a spring channel for holding said locking spring.

5. A sport shoe according to claim 1, wherein said locking spring comprises a torsion spring having spring sides extending into said receptacle for releasably locking said locking pin in said receptacle.

6. A sport shoe according to claim 5, wherein said locking pin comprises locking surfaces, and wherein said spring sides of said locking spring have a locked state for engaging said locking surfaces for preventing movement of said cleat in the longitudinal or lateral direction.

7. A sport shoe according to claim 5, wherein said locking pin comprises insertion inclines for pushing apart said spring sides of said locking spring in response to said cleat being pushed into said receptacle.

8. A sport shoe according to claim 7, wherein said insertion inclines are diametrically opposed and have an angle between 35° and 45° with respect to the longitudinal axis of said cleat.

9. A sport shoe according to claim 5, wherein said locking pin comprises locking surfaces, and wherein said spring sides of said locking spring have a locked state for engaging said locking surfaces for preventing movement of said cleat in the longitudinal and lateral direction.

10. A sport shoe according to claim 9, wherein said locking surfaces are diametrically opposed and have an angle of between 85° and 95° with respect to the longitudinal axis of said cleat.

11. A sport shoe according to claim 10, wherein said locking surfaces have an angle of 90° with respect to the longitudinal axis of said cleat.

12. A sport shoe according to claim 10, wherein said locking surfaces have a length of at least one half the diameter of said spring sides.

13. A sport shoe according to claim 12, wherein said cleat is configured for rotation by means of a tool.

14. A sport shoe according to claim 13 wherein the tool has recesses, and wherein said cleat has an outer surface, and said cleat comprises spurs extending from the outer surface complementary to recesses in the tool and said spurs mate with the recesses in said tool.

15. A sport shoe according to claim 1, wherein said locking pin comprises spreading surfaces for pushing said spring sides in opposite directions away from said support walls in response to the rotation of said cleat for releasing said locking pin from said locked condition in said receptacle.

16. A sport shoe for holding at least one removable cleat, said sport shoe comprising:

a sole having at least one receptacle for receiving a cleat;

a removable cleat having a longitudinal axis and a locking pin along the longitudinal axis of said cleat; and a locking spring located in said receptacle;

wherein said locking spring is an open locking spring;

said locking spring engaging said locking pin for locking said cleat to said sole in response to the insertion of said locking pin into said receptacle;

wherein said sole further comprises a spring channel extending from and around said receptacle and having support walls in said spring channel, and said spring sides being pre-tensioned in the direction of said receptacle and being supported off said support walls, said spring sides having a locking condition for engaging said locking pin to releasably lock said pin in a locked condition in said receptacle.

* * * * *